United States Patent [19]

Kirisawa

[11] 4,325,320

[45] Apr. 20, 1982

[54] APPARATUS EMPLOYED IN SURFACE TREATMENT

[75] Inventor: Atsushi Kirisawa, Aichi, Japan

[73] Assignee: Japan Envirotic Industry Co., Ltd., Nagoya, Japan

[21] Appl. No.: 159,111

[22] Filed: Jun. 13, 1980

Related U.S. Application Data

[62] Division of Ser. No. 90,578, Nov. 2, 1979, Pat. No. 4,294,626.

[30] Foreign Application Priority Data

Nov. 9, 1978 [JP] Japan ..... 53-138487

[51] Int. Cl.[3] ..... B05C 3/04

[52] U.S. Cl. ..... 118/52; 118/304; 118/416; 427/240; 427/345

[58] Field of Search ..... 118/304, 303, 52, 416; 427/240, 241, 345; 134/151, 155, 157; 68/132

[56] References Cited

U.S. PATENT DOCUMENTS

| | | | |
|---|---|---|---|
| 1,686,313 | 10/1928 | Dreher et al. | 118/52 |
| 2,009,232 | 7/1935 | Hood | 118/52 |
| 2,105,094 | 1/1938 | Pearce | 134/25.1 |
| 2,158,981 | 5/1939 | Collins et al. | 427/240 |
| 3,340,090 | 9/1967 | Nordeman | 427/345 |
| 3,688,906 | 9/1972 | Ferrara | 118/52 |
| 3,771,490 | 11/1973 | Kinney et al. | 118/421 |
| 4,170,191 | 10/1979 | Juve | 118/303 |

FOREIGN PATENT DOCUMENTS

| | | | |
|---|---|---|---|
| 148225 | 9/1952 | Australia | 118/52 |
| 2707921 | 8/1978 | Fed. Rep. of Germany | 118/52 |

*Primary Examiner*—Ralph S. Kendall

*Attorney, Agent, or Firm*—Cooper, Dunham, Clark, Griffin & Moran

[57] ABSTRACT

The surface treatment is carried out by employing an apparatus comprising a vessel and a holed container rotatably equipped in said vessel.

Materials to be treated are filled into said holed container of said apparatus then treating liquids and/or washing liquids are charged in order into said holed container according to the treatment process and said holed container is driven to rotate thus treating liquids and/or washing liquids contact whole surface of said materials and the treatment is carried out. After the treatment, treating liquids and/or washing liquids are effectively removed from the surface of said materials by the centrifugal force accompanying with the rotation of said holed container.

1 Claim, 6 Drawing Figures

APPARATUS EMPLOYED IN SURFACE TREATMENT

This is a division of application Ser. No. 090,578 filed Nov. 2, 1979, U.S. Pat. No. 4,294,626.

BACKGROUND OF THE INVENTION

1. Field of the Invention

The invention relates to a surface treatment such as washing, etching, plating, chromate treatment, zinc-chromate treatment and the like. More particularly, the invention relates to a surface treatment employing a rotary treating apparatus.

2. Description of the Prior Art

Hitherto, in surface treating process, materials to be surface-treated are dipped in a fixed order into various kinds of treating liquids and/or washing liquids filled respectively in treating tanks. For instance, materials are treated in order of plating, water washing, chromate treatment, water washing, removing of washing water and drying in chromate treatment process, and materials to be treated are conveyed and dipped in order of plating tank, water washing tank, chromate treatment tank, water washing tank, dehydrator and dryer.

In said prior art, a treating tank or treating apparatus is necessary for a treating process so wide space is necessary to install said treating tanks and treating apparatus, and conveying of materials to be treated between treating tanks and/or treating apparatus is necessary so some hands and/or equipments are necessary for conveying. Further, in said prior art, materials to be treated are apt to be injured during conveying and it is difficult to avoid mixing of treating liquids and/or washing liquids reciprocally by accompanying with materials to be treated.

In case that treating liquids are harmful materials such as chromate solution in chromate treatment, a large amount of washing liquids contaminated by such harmful materials must be treated to remove public nuisances.

SUMMARY OF THE INVENTION

An object of this invention is to provide a compact apparatus for the surface treatment, which is not necessary a wide space to install.

Another object of this invention is to save hands and equipments for conveying and avoid injuring of materials to be treated by exclusion the conveying process.

Further object of this invention is to avoid the reciprocal contamination of treating liquids and/or washing liquids.

Said objects can be attained by a method of the surface treatment employing a rotary treating apparatus.

Figure 1:
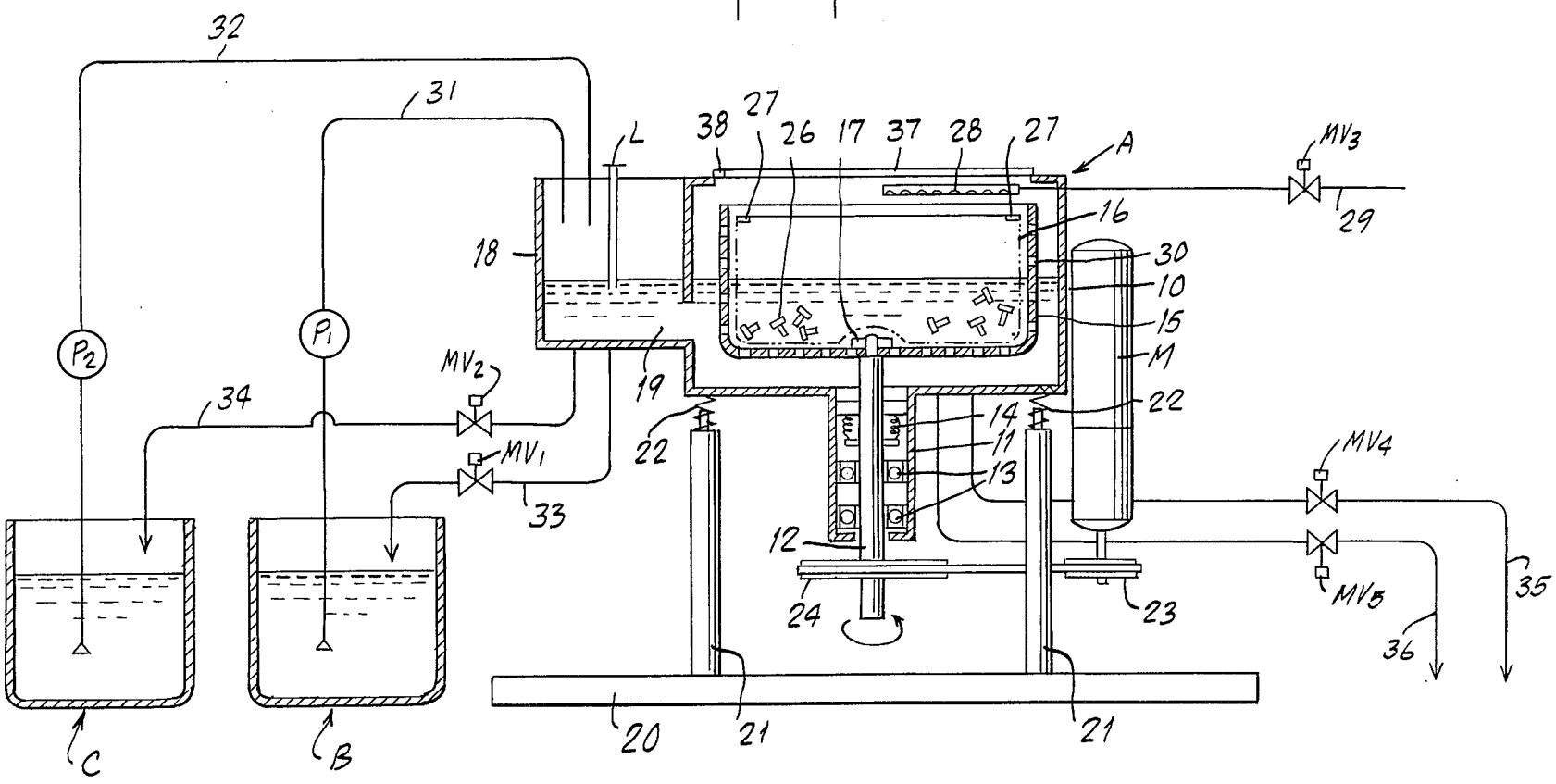
FIG. 1 shows a front sectional view of the surface treatment apparatus.

In figures;

(10) . . . vessel,

(12) . . . axis,

(15) . . . holed container,

(16) . . . cage,

(26) . . . materials to be treated,

(28) . . . washing nozzle,

(29) . . . washing liquid supplying pupe, $MV_1$, $MV_2$, $MV_3$, $MV_4$, $MV_5$ . . . magnetic valves, M . . . brake motor

DETAILED DESCRIPTION OF THE PREFERRED EMBODIMENT

A surface treating system shown in the drawings is employed for the chromate treatment and comprises a surface treating apparatus A, a nitric acid tank B and a chromate tank C.

Figure 2:
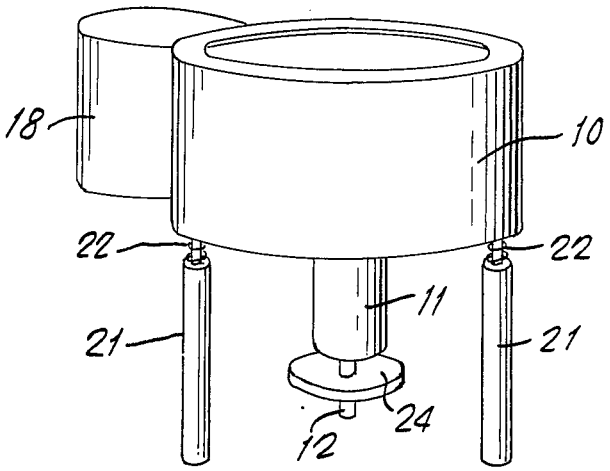
FIG. 2 shows a oblique view of the main body of this surface treatment apparatus.
Figure 3:
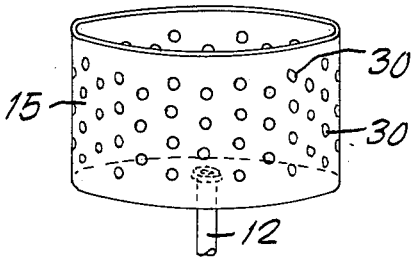
FIG. 3 shows a oblique view of the holed container.

Referring now to the drawings, said surface treating apparatus A comprises a vessel 10 which is supported springs 22 being between said vessel 10 and legs 21 standing on a base 20, put on a lid 37 pivotally attached on the upper edge of said vessel 10 by a hinge 38 and connects with a returning pipe 33 having a magnetic valve $MV_1$, a returning pipe 34 having a magnetic valve $MV_2$, an exhausting pipe 35 having a magnetic valve $MV_4$ and an exhausting pipe 36 having a magnetic valve $MV_5$ at its bottom; a supplying tank 18 which is fitted upon the outside of said vessel 10 as shown in FIG. 2, connects with the inside of said vessel 10 through a connecting opening 19, and inserted a level gauge L, a holed container 15 having numberless holes 30 as shown in FIG. 3, which is rotatably attached on a axis 12 by a nut 17, piercing through the bottom of said vessel 10, supported by a pair of bearings 13, 13, sealed by a mechanical seal 14 in a bearing box 11 and fixing a pulley 24 at its under part, connecting with a pulley 23 fixed on a axis of a brake motor M through a belt 25; one or more buffer blades may be fixed to the base of said holed container if desired, because said buffer blade gives a turbulence to treating liquids or washing liquids to result effective contact of materials with said liquids, and a washing nozzle 28 inserted in said vessel 10 at its upper part and connecting with a washing liquid supplying pipe 29 having a magnetic valve $MV_3$.

Said nitric acid tank B connects with a supplying pipe 31 having a pump $P_1$ and connecting with said supplying tank 18 of said surface treating apparatus A at its upper part, and returning pipe 33 having a magnetic valve $MV_1$ and connecting with said supplying tank 18 at its bottom, said chromate tank C connects with a supplying pipe 32 having a pump $P_2$ and connecting with said supplying tank 18 at its upper part and a returning pipe 34 having a magnetic valve $MV_2$ and connecting with said supplying tank 18 at its bottom.

A chromate treatment employing said surface treating system is explained as follows.

Figure 4:
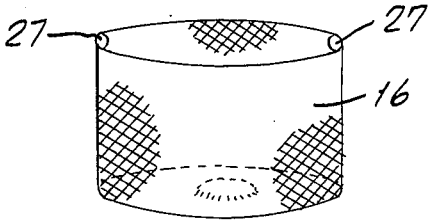
FIG. 4 shows a oblique view of the cage.

Material 26 to be treated such as galvanized bolts, galvanized nuts and the like are filled into a cage 16 which is made of wire net and fixed a pair of catches 27 at its upper edge as shown in FIG. 4. One or more buffer blades may be fixed to the base of said cage if desired, because said buffer blade gives a turbulence to treating liquids a washing liquids to result effective contact of materials with said liquids. The lid 37 of the vessel 10 is opened then said cage 16 filling said materials 26 is put into the holed container 15 of said vessel 10. The lid 37 of the vessel 10 is shut thus the preparation have been ready.

A chromate treatment process comprises, first washing process, nitric acid dipping process, second washing process, chromate solution dipping process, third washing process, dehydrating process and drying process.

In first washing process, the holed container 15 is driven to rotate by the brake motor M and washing water is sprayed from the nozzle 28 by opening of the magnetic valve $MV_3$. In this process, the holed container 15 keeps a fixed rotation or the holed container 15 is rotated intermittently or alternatively and washing water is successively exhausted through the exhausting pipe 35 by opening of the magnetic valve $MV_4$ or washing water is once accumulated in the vessel 10 without opening of the magnetic valve $MV_4$ then exhausted by opening of the magnetic valve $MV_4$ after washing has been completed.

Dehydration after washing is carried out by a fixed rotation of the holed container 15 with opening of the magnetic valve $MV_4$, and the waste water is exhausted through the exhaust pipe 35. During said washing process, washing water is effectively contacted with the surfaces of materials 26 and removes effectively galvanizing solution remaining on the surface of materials 26.

In nitric acid dipping process, nitric acid solution in the nitric acid tank B is poured into the vessel 10 through the supplying pipe 31 and supplying tank 18 by driving of the pump $P_1$. The solution level is detected by the level gauge L and the pump $P_1$ is stopped to drive when the solution level reached a fixed level where materials 26 dip entirely in said solution. During said supplying of said solution, the holed container 15 keeps a fixed rotation or the holed container 15 is rotated intermittently or alternatively, or the rotation of the holed container 15 is stopped. After said supplying of said solution, the magnetic valve $MV_1$ of the returning pipe 33 is opened with a fixed rotation of the holed container 15 and nitric acid solution in the vessel 10 is withdrawn to the nitric acid tank B.

In second washing process, the magnetic valve $MV_1$ of the returning pipe 33 is shut and the magnetic valve $MV_5$ of the exhausting pipe 36 is opened then the same process as first washing process is carried out.

In chromate solution dipping process, the magnetic valve $MV_5$ of the exhausting pipe 36 is shut and chromate solution in the chromate tank C is poured into the vessel 10 through the supplying pipe 32 and supplying tank 18 by driving of the pump $P_2$. The solution level is also detected by the level gauge L and the pump $P_2$ is stopped to drive when the solution level reached a fixed level on which materials 26 dip entirely in the solution. During said supplying of said solution, the holed container 15 keeps a fixed rotation or the holed container 15 is rotated intermittently or alternatively, or the rotation of the holed container 15 is stopped. After said supplying of said solution, the magnetic valve $MV_2$ of the returning pipe 34 is opened with a fixed rotation of the holed container 15 and the chromate solution in the vessel 10 is withdrawn to the chromate tank C.

In third washing process, the magnetic valve $MV_2$ of the returning pipe 34 is shut and the magnetic valve $MV_5$ of the exhausting pipe 36 is opened then the same process as first washing process is carried out. After said chromate treatment process has been completed, the lid 37 of the vessel 10 is opened and the cage 16 is taken out from the vessel 10 then materials filled in the cage 16 are dried up by heating and/or ventilating with or without centrifugal separating.

Dehydrating and drying is able to be carried out in the vessel 10 in case that the rotation speed of the holed container 15 is able to be changed by connecting the axis 12 of the holed container 15 with a low speed motor and a high speed motor or by equipping a variable speed gear or the like, and a dryer is equipped upon the vessel 10. An apparatus system shown in FIG. 5 and FIG. 6 is available for said chromate treatment.

Figure 5:
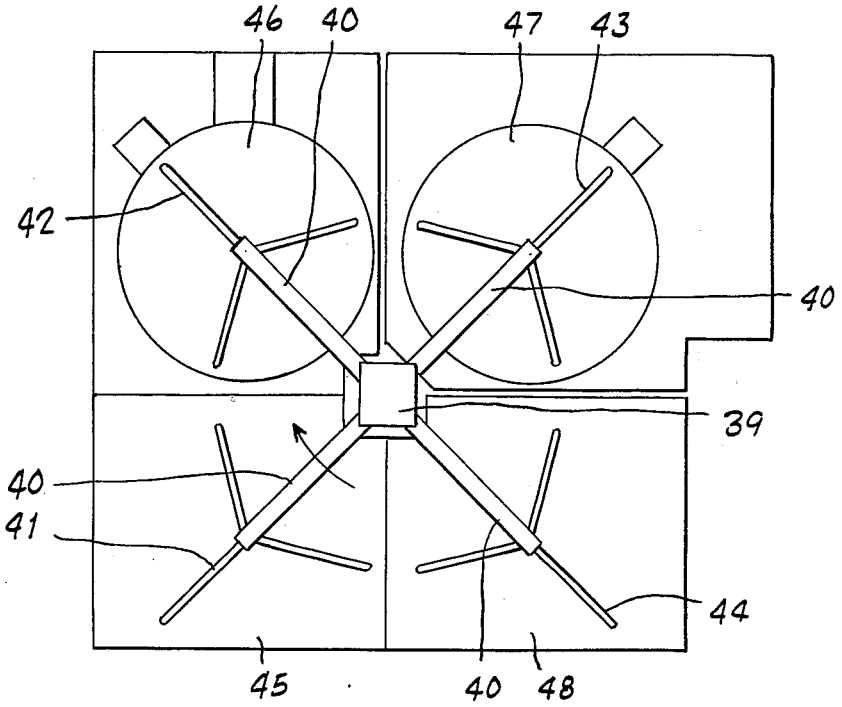
FIG. 5 shows a lateral view of an apparatus system.
Figure 6:
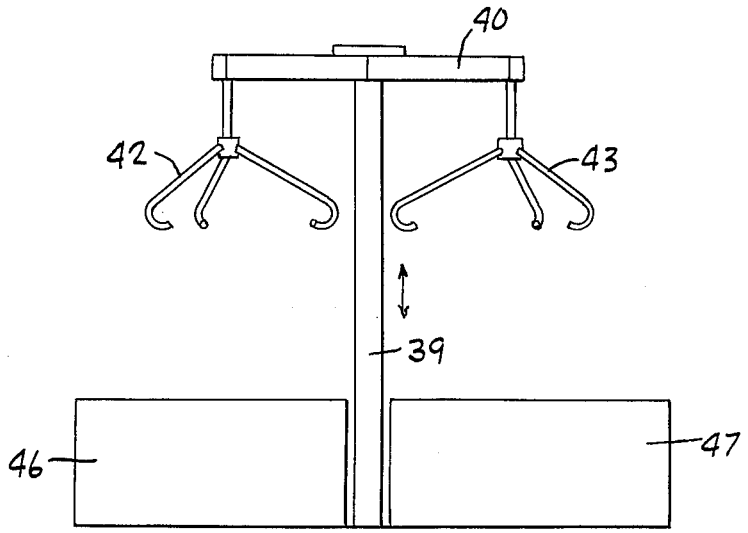
FIG. 6 shows a front view of an apparatus system.

Referring now to FIG. 5, a stand 39 being able to move up and down is rotatably attached a crossbeam 40 which hangs grips 41, 42, 43 and 44 grasping the cage 16 and said stand 39 is surrounded by four sections comprising a section 45 where materials 26 are filled into the cage 16, a section 46 where the surface treating apparatus A is set and the chromate treatment of materials 26 is carried out, a section 47 where centrifugal dryer is set and treated materials 26 is dried, and a section 48 where treated materials 26 are taken out from the cage 16. Thus materials 26 in the cage 16 are conveyed in order of the section 45, the section 46, the section 47 and the section 48 by up and down motion of the stand 39 and rotation of the crossbeam 40, and the chromate treatment of materials 26 is successively carried out.

As above mentioned, various plural processes are able to be carried out in one apparatus in this invention. Therefore, said apparatus is very compact and needs no wide space to install said apparatus and conveying of materials to be treated are also not necessary, thus any hands and/or equipments are not necessary for conveying and injuring of materials during conveying is completely protected. Further, treating liquids or washing liquids are completely contacted with materials to be treated by centrifugal effect accompanying rotation of the holed container, so washing and surface treating are carried out effectively. Still further, removing of treating liquids or washing liquids from the surface of materials are also carried out effectively by said centrifugal effect so reciprocal contamination of treating liquids and/or washing liquids are also effectively protected.

This invention can be applied on various surface treatment such as water washing, alkaline washing, trichloroethylene washing and the like; electric plating, electroless plating, etching and the like; phosphoric acid treatment, anticorossive treatment and the like; chromate treatment, zinc-chromate treatment and the like.

We claim:

1. An apparatus employed in surface treatment which comprises a stationary vessel, an open top holed container rotatably mounted within said vessel, an open top cage adapted to be positioned within said container for rotation therewith, one or more washing nozzles fixed to said vessel at its upper part and adapted for treating or washing the contents of said cage within said container, and a supply tank attached to the outside of said vessel which connects with one or more tanks of treating liquid and/or washing liquid for supplying said treating liquid or washing liquid to said vessel through an aperture in said vessel.

* * * * *